US011065912B2

(12) United States Patent
Iwai et al.

(10) Patent No.: US 11,065,912 B2
(45) Date of Patent: Jul. 20, 2021

(54) METHOD OF RESTORING PAINTINGS

(71) Applicants: Kikuko Iwai, Chiba (JP); Kie Iwai, Chiba (JP); MITANI SANGYO Co., Ltd., Ishikawa (JP)

(72) Inventors: Kikuko Iwai, Chiba (JP); Kie Iwai, Chiba (JP)

(73) Assignees: Kikuko Iwai, Sakura (JP); Kie Iwai, Sakura (JP); MITANI SANGYO Co., Ltd., Kanazawa (JP)

( * ) Notice: Subject to any disclaimer, the term of this patent is extended or adjusted under 35 U.S.C. 154(b) by 0 days.

(21) Appl. No.: 16/694,164

(22) Filed: Nov. 25, 2019

(65) Prior Publication Data

US 2020/0164679 A1 May 28, 2020

(30) Foreign Application Priority Data

Nov. 28, 2018 (JP) ..... JP2018-222692

(51) Int. Cl.
*B44D 7/00* (2006.01)

(52) U.S. Cl.
CPC ..... *B44D 7/00* (2013.01)

(58) Field of Classification Search
CPC ..... B44D 7/00
See application file for complete search history.

(56) References Cited

FOREIGN PATENT DOCUMENTS

| | | | | |
|---|---|---|---|---|
| EP | 0686512 A1 * | 12/1995 | ..... | B44F 11/02 |
| JP | 3335309 B2 * | 10/2002 | ..... | B44F 11/02 |
| JP | 2016-093977 A | 5/2016 | | |
| JP | 2016093977 A * | 5/2016 | ..... | B44F 11/02 |
| WO | WO-200074955 A1 * | 12/2000 | ..... | B44D 3/003 |

OTHER PUBLICATIONS

Communication with European Patent Office concerning the citation of JP2016093977A in counterpart application EP3659816A1, dated Nov. 23, 2020, 3 pages. (Year: 2020).*
Extended European Search Report issued for the counterpart European Patent Application No. 19210813.2 dated Apr. 22, 2020.
Shinichi SEGI, Great picture restoration, Kodansha Co., Ltd., p. 81, lines 4 to 12, May 20, 1995.

* cited by examiner

*Primary Examiner* — William P Fletcher, III
(74) *Attorney, Agent, or Firm* — IP Business Solutions, LLC

(57) ABSTRACT

A method of restoring paintings includes steps for acquiring image data of a painting having a deteriorated part evidencing deterioration including at least one selected from among fading, exfoliation, and damage or loss of the support; generating digital restoration data in which the damaged part of the image data is restored by digital simulation using a computer; printing the digital restoration data on a backing of the painting using ink; and lamination of the printed backing material of the painting to the back of the painting.

10 Claims, 2 Drawing Sheets

[Fig. 1]
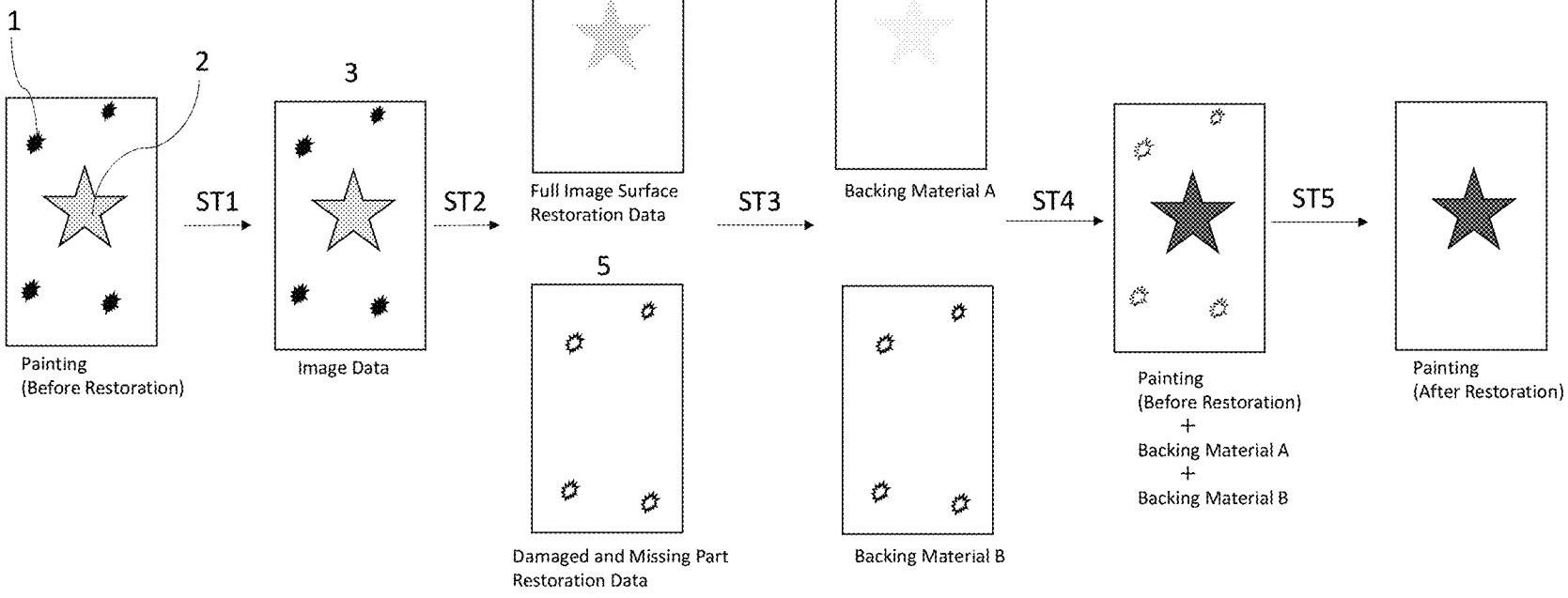

[Fig. 2]
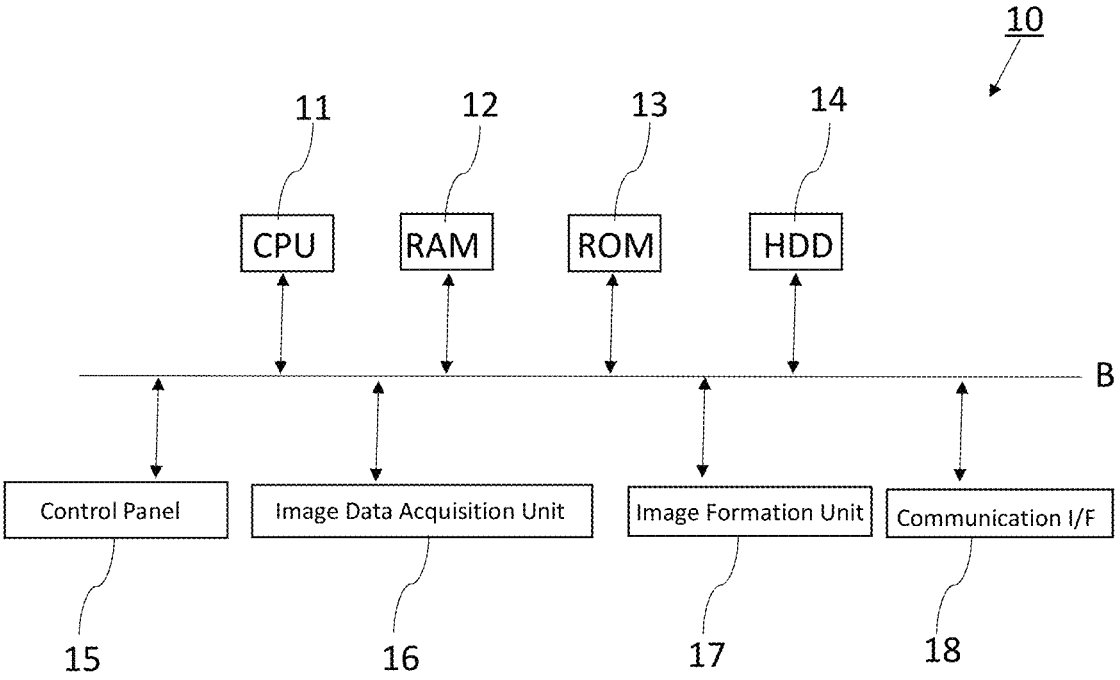

METHOD OF RESTORING PAINTINGS

CROSS-REFERENCE TO RELATED APPLICATIONS

The present application claims priority under 35 U.S.C. 119 to Japanese Patent Application No. 2018-222692, filed on Nov. 28, 2018. The contents of this application are incorporated herein by reference in their entirety.

BACKGROUND OF THE INVENTION

Field of the Invention

The present invention relates to a method of restoring paintings.

A painting is constructed by laminating a paint layer onto a support. As the composition of a painting, oil paintings composed of oil paint laminated on canvas as a support, watercolor paintings composed of water soluble paint laminated on Japanese "washi" paper as a support and silk paintings composed of water soluble paint laminated on silk as a support may be given as examples.

Fading of the paint layer, exfoliation of the paint layer, or damage to or loss of the support and the like may be given as examples of primary causes of damage to paintings. The aforementioned fading or exfoliation of the paint layer are produced primarily by the passage of a long period of time, and the aforementioned damage to or loss of parts of the support are often caused by accidents or destructive events. Hereinbelow, the faded locations of the painting shall be referred to as the Faded Part, the exfoliated locations as the Exfoliated Part, and the damaged or lost portions as the Damaged Part.

Description of the Related Art

Methods of filling and supplementary coloring are widely used for the restoration of damaged paintings (NPTL 1).

Filling is a procedure in which the filling material is put in the Damaged Part or the Exfoliated Part, and the height of the filling material is matched with that of the surrounding original paint layer. Generally, a mixture of calcium carbonate and glue or a mixture of calcium carbonate and a synthetic resin is used for filling the paint layer, and, generally, the same material as used in the original support such as canvas, Japanese paper, silk or the like is used for filling of the support.

Supplementary coloring is a procedure to add color to the Exfoliated Part. The supplementary coloring materials used in restoration may be subsequently removed without damage to the painting, and moreover the most stable restoration use coloring materials are used.

Because restoration conducted by these prior art conventional methods was carried out manually upon the parts to be restored, they required an enormous amount of time in cases where there were a large number of parts to restore. In repairs conducted by prior art manual work, considerable variability occurs in the quality of the finish depending upon the skill of the restorer, and there are cases where the value of the painting is impaired.

Moreover, because the value of an original painting may be damaged by carrying out supplemental coloring from the surface of a faded painting, it may be impossible to use it as a restoration method, and so far supplemental coloring has not been established as a method for the restoration of Faded Parts in paintings.

CITATION LIST

Non Patent Literature

NPTL 1: Shinichi Segi (Author): Great picture restoration Kodansha, p. 81 (1995)

SUMMARY OF THE INVENTION

The present invention has been made in view of such circumstances, solves the problems of the afore-stated prior art, and was made for the purpose of providing a method of restoring paintings that can shorten the time of restoration work. Another object of the present invention is to provide a method of restoring paintings which can control variability of quality due to the restorer's levels of skill.

The present invention provides the following [1] to [10].

[1] A method of restoring paintings includes the steps of image data acquisition from a painting having a deteriorated part in which deterioration has occurred in forms including at least one selected from among fading of color, exfoliation of paint, and damage to or loss of the support (hereinafter referred to as the "Image Data Acquisition Step"); generating Digital Restoration Data in which the image data of the deteriorated part is restored in digital simulation using a computer (hereinafter referred to as the "Digital Restoration Data Generation Step"); printing the Digital Restoration Data on a backing material of a painting using ink (hereinafter referred to as the "Printing Step"); and of the lamination of the backing material after the Printing Step onto the back surface of the painting (hereinafter referred to as the "Backing Step").

[2] The Image Data Acquisition Step is preceded by a step of flattening the painting (hereinafter referred to as the "Flattening Step").

[3] The Image Data Acquisition Step is preceded by a process of cleaning the surface of the painting by removing dirt and the like (hereinafter referred to as the "Cleaning Step").

[4] The Digital Restoration Data includes full image surface restoration data that digitally restores the entire image surface of the painting.

[5] The full image surface restoration data is obtained by performing contour blurring processing after full image surface digital restoration.

[6] The Full Image Surface Restoration Data is obtained by subjecting the data in which the damage or loss and/or exfoliation of the Damaged Part have been digitally restored by a color-thinning process.

[7] The painting has a deteriorated part where a loss or damage has occurred, and the Digital Restoration Data includes Damaged Part Restoration Data for supplementing the loss or damage.

[8] The Damaged Part Restoration Data is obtained by subjecting to a color lightening process the data in which digital restoration of the damage or loss of the deteriorated part has been carried out.

[9] The lamination is carried out via an adhesive layer formed by applying an adhesive.

[10] The lamination is carried out without using an adhesive layer formed by applying an adhesive.

BRIEF DESCRIPTION OF THE DRAWINGS

FIG. 1 is a drawing according to an embodiment of the present invention explaining the flow of the process of the restoration of a painting according to the embodiment.

FIG. 2 is a drawing according to an embodiment of the present invention showing examples of hardware configurations of the equipment for generation of Digital Restoration Data using the configuration of that embodiment.

DETAILED DESCRIPTION OF THE INVENTION

Hereinbelow are explained in detail each of the steps of the embodiment of the present invention.

The restoration method of the present invention may be applied to any painting. However, in particular, it may be used suitably to restore works comprising oil paint laminated onto canvas and from which canvas is missing or in which it has been damaged; works comprising a piece of paper, Japanese "Washi" paper or silk, upon which watercolor composed of water soluble paint has been superimposed, and from which such paper, Japanese Paper or silk is missing or in which it has been damaged; works comprising a piece of paper, Japanese "Washi" paper or silk, upon which watercolor composed of water soluble paint has been superimposed, and in which the paint has faded; works comprising a piece of paper, Japanese "Washi" paper or silk, upon which watercolor composed of water soluble paint has been superimposed, and from which paint has exfoliated; works comprising a piece of paper, Japanese "Washi" paper or silk, upon which prints and/or drawings have been superimposed, and from which such paper, Japanese Paper or silk is missing or in which it has been damaged; works comprising a piece of paper, Japanese "Washi" paper or silk, upon which prints and/or drawings have been superimposed, and in which the color has faded; works comprising a piece of paper, Japanese "Washi" paper or silk, upon which prints and/or drawings have been superimposed, and from which prints and/or drawings have exfoliated.

The Japanese "Washi" paper and the silk both have a light transmission characteristics that diffuses light and transmits half of it. The canvas does not have such a light transmission characteristics.

In the following embodiment, a method of restoring a silk painting having Damaged Part 1 and the Faded Part 2 will be described with reference to FIG. 1.

(Image Data Acquisition Step: ST1)

In the Image Data Acquisition Step, image data of a painting having a Damaged Part including at least one form of damage selected from among fading, exfoliation and loss or damage, is acquired.

The method of acquiring image data is not particularly limited, and, for example, may include the use of a scanner. Direct scanning of the image surface of the painting may be employed and scanning of a photograph taken of the image surface of the painting may also be employed.

The silk painting to be restored in the present embodiment possesses Damaged Parts 1 and a Faded Part 2 as shown in FIG. 1.

The Image Data 3 of a painting having Damaged Part(s) 1 and Faded Part(s) 2 is acquired during the Image Data Acquisition Step (ST1) of the present embodiment as shown in FIG. 1. Damaged Part 1 of the present embodiment is an area in which a hole has formed in the silk material which is the support of the painting, and Faded Part 2 is an area in which the color of the paint has faded and or discoloration has occurred.

(Digital Restoration Data Generation Step: ST2)

In the Digital Restoration Data Generation Step, Digital Restoration Data in which the deteriorated parts (in the present embodiment, the Damaged Part 1 and Faded Part 2) is restored from the image data acquired in the Image Data Acquisition Step. In the present invention, Digital Restoration means generating a restored image by digital simulation using a computer.

It is preferred that the Digital Restoration Data include Full Image Surface Restoration Data obtained by digitally restoring the full image surface of the painting and/or Damaged Part Restoration Data that compensates for lost or damaged data.

It is preferred as well that Full Image Surface Restoration Data be obtained by conducting contour blur processing following digital restoration of the full image surface.

Because Digital Restoration Data is made use of by printing it to the backing material of the painting and, after printing, laminating the backing material to the back of the painting, it is preferred that color lightening processing be conducted based on the current color tone with respect to data obtained by digitally restoring the deteriorated part (hereinafter referred to as Damaged Part Restoration Data). It is possible, for example, to restore a faded watercolor or silk painting without supplementing the original image surface, by printing the Full-Image Surface Restoration Data that has been subjected to a process to lighten the color to be printed on the backing material and then laminating the printed backing material onto the back of the painting.

It is possible to conduct the color lightening process by means of image processing software available on the market such as, for example, Photoshop (Registered Trademark) produced by Adobe Systems. The optimum degree of color lightening processing can be obtained by adjustment according to the style of the painting, the material comprising the backing material, and the kind of restoration aimed for (for example, whether to aim for the restoration of the original painting at the time of creation, or the restoration with some degree of aging), but it is preferred to conduct the process so that the restoration to the extent of 10 to 90% of the restoration data color intensity for the deteriorated parts and the like is achieved, and it is even more preferred to conduct the color lightening process so that they possess a color intensity of 30 to 70% of that of the restoration data of deteriorated parts and the like.

In the event that the full image surface Digital Restoration Data and the Damaged Parts restoration data are included in the Digital Restoration Data, it is preferred to carry out the process of color lightening with respect to each of the Full Image Surface Restoration Data and the Damaged Parts restoration data so that the color intensity is 10% to 90% of that of the Damaged Parts Restoration Data and the like in circumstances where films containing printed images of the Full Image Surface Restoration Data and the Damaged Parts Restoration Data are laminated together, and it is more preferred to carry out the process of lightening the color intensity with respect to each of the Full Image Surface Restoration Data and the Damaged Parts Restoration Data so that the color intensity is 30% to 70% of that of the Damaged Parts Restoration Data and the like in circumstances where the printed images of the full Image Surface Restoration Data and the Damaged Parts Restoration Data are laminated together.

When the backing material possesses a tint, the hue and/or saturation may be appropriately adjusted in consideration of the tint of the backing material at the time of creation of Damaged Part Restoration Data and the like.

As shown in FIG. 1, in the Digital Restoration Data Generation Step (ST2) of the present embodiment, the Digital Restoration Data is generated following Digital Restoration of the full image surface of the painting from Full Image Surface Restoration Data 4 obtained by performing contour blur processing, and Damaged Part Digital Restoration Data 5 supplementing Damaged Part 1.

In the specifications of the present invention, "contour blur processing" means a process that blurs the boundary between the inside and the outside of an outer contour of a painting and smooths the color tone, brightness and the like of both the inside and outside, and can be carried out, for example, by commercially available image processing software such as Adobe Systems' Photoshop (Registered Trademark) and the like.

(Printing Step: ST3)

In the Printing Step, the Digital Restoration Data generated by the aforesaid Digital Restoration Data Generation Step, are printed on the backing material of the painting using ink.

For example, in the case of restoring the image of a silk painting as in the present embodiment, it is preferred to print on Japanese "Washi" paper using a non-water soluble ink.

There are no particular limitations on the device configurations for performing the Image Data Acquisition Step, the Digital Restoration Data Generation Step, and the Printing Step, for example, and the Digital Restoration Data Generation Device 10 may have the hardware configuration shown in FIG. 2.

The Digital Restoration Data Generation Device 10 of FIG. 2 includes a CPU 11, a random-access memory (RAM) 12, a read only memory (ROM) 13, an HDD 14, a Control Panel 15, an Image Data Acquisition unit 16, an Image Forming Unit 17 and a Communication I/F 18 and these exchange necessary data via the bus B.

CPU 11 functions by loading various programs stored in ROM 13 or the like into RAM 12 and executing the programs.

RAM 12 is a memory used as a working memory or the like of CPU 11.

ROM 13 is a memory for storing various programs and the like executed by CPU 11.

HDD 14 is, for example, a magnetic disk device that stores image data read by the Image Data Acquisition Unit 16, Digital Restoration Data used in image formation in Image Formation Unit 17, and the like.

Control Panel 15 is, for example, a touch panel that displays various information and accepts operation input from the user.

Communication I/F 18 transmits and receives various information to and from other devices via a network.

The Image Data Acquisition Unit 16 reads an image of a painting. Here, the Image Data Acquisition Unit 16 may be, for example, a scanner, and it is preferred to use a CCD (Charge Coupled Device) that reduces reflected light from the light source to the image surface of the painting using a lens and receives the reflected light by a CCD, or a CIS (Contact Image Scanner) that receives reflected light sequentially emitted to the surface of the painting from an LED light source.

The Image Forming Unit 17 is one example of a printing mechanism that forms an image on a backing material. Here, the Image Forming Unit 17 may be, for example, a printer, and can use an inkjet method that forms an image by discharging ink onto a backing material.

(Backing Step: ST4)

In the Backing Step, the backing material that has been printed upon in the Printing Step is laminated onto the back of the painting. The lamination can also be performed via an adhesive layer formed by applying an adhesive.

Backing is the treatment by which a backing material such as cloth is laminated to the back of the original support. Backing is usually performed by applying a backing material to the back of the original support and applying heat and pressure through an adhesive layer formed by application of an adhesive. At that time, the original texture of the paint layer is easy to impair by the heat and pressure applied to the support, and more specifically, the brushstrokes of the paint layer become flat, the paint darken, and sometimes burn.

In the Backing Step of the present invention, the backing material printed upon in the Printing Step is laminated onto the back of the painting without applying heat, thereby overcoming the disadvantages of the prior art.

As the Backing Step of the present invention, for example, a method of laminating the backing material to the back of the painting by means of a water soluble adhesive may be used, and a method of laminating to the rim or panel of a wooden frame holding the support without laminating through an adhesive layer applied by an adhesive may be used.

As described above, according to the restoration method of the present invention in which Digital Restoration Data obtained by digital restoration is printed on a backing material and laminated on the back of a painting, thus accomplishing the restoration, the time for restoration work can be broadly reduced compared to that of the prior art. Moreover, it is possible to limit variation due to the differing skills of the workmen. In addition, because it is preferable to perform the restoration of paintings regularly, saving the Digital Restoration Data can greatly reduce the time and cost required for periodic restoration work.

Furthermore, as described above, no method for restoring faded paintings has been established in the prior art, but according to the restoration method of the present invention, a backing material on which Digital Restoration Data can be expressed to compensate for fading may be printed on the backing material and then the backing material laminated on the back surface of the faded part so that it is also possible to restore the Faded Parts. More specifically, it is possible to perform color supplementation to counter fading using the restoration method of the present invention in cases wherein it is possible to see the image based upon the restoration data printed on backing material which can be seen through the surface of paintings such as silk paintings using silk as a support or Japanese paintings using Japanese "Washi" paper as a support following the Backing Step.

(Supplementation Step: ST5)

As shown in FIG. 1, when a painting having a Damaged Part 1 is to be backed, after adhering Backing Material B upon which the Damaged Part Restoration Data been printed, it is also possible to carry out a process to make the Damaged Part 1 inconspicuous by adding in color to the outline of Damaged Part 1 from the side of the paint layer.

(Steps Preceding the Image Data Acquisition Step: ST0)

As Steps Preceding the Image Data Acquisition Step, it is preferred to provide a Flattening Step which flattens the painting and/or a Cleaning Step which cleans the surface of the painting.

The Flattening Step is a step aiming to restore the flatness of the image surface by eliminating distortion and sagging of the painting and/or deformation caused by cracking of the painting. For example, it is possible to employ a method of applying moisture to the painting to smooth a large number of cracks that have been generated in the paint layer and to flatten the support.

For example, in the case of an application of the present invention to oil paintings using canvas as a support, it is possible to illustrate the steps of a flattening process consisting of an attachment step for attaching a retaining belt possessing a belt-like member that uses hook and loop fasteners and a retaining member for retaining the canvas, to the outer edge of the canvas; a step of placing the canvas attached to the retaining belt within the space of the frame possessing a space where the canvas can be placed; a step of attaching the retaining belt to the frame and covering the frame with a sheet possessing low gas permeability to form a closed space below the frame; a step of humidifying the closed space until the humidity reaches a peak of 80% RH or higher and then ceasing humidification after achieving the peak humidity; a step of leaving the canvas within the closed space for 2 to 5 hours while finely adjusting the position of fastening of the retaining belt; and a step for natural drying of the canvas for 6 to 12 hours under conditions preserving the same position as the attachment step after removing the sheet material.

Moreover, in the event that the image is a water color painting using paper or Japanese "Washi" paper as the support or a silk painting using silk as the support, it is possible to carry out a Flattening Step that adds moisture to paper, Japanese "Washi" paper or silk that is the support, induces a temporary tension thereupon, and then allows natural drying to occur.

The Cleaning Step is a step intended to remove dust and varnish from the painting front surface.

Depending upon the object of the work, it is possible to adopt an optimal method from among methods of the prior art to perform dry cleaning without using a solvent or methods in which cleaning is conducted with a prepared solvent. In dry cleaning methods, dirt may be removed using a brush or sponge. In cleaning with a prepared solvent, dirt and varnish may be removed from the surface.

By cleaning, it is possible to restore the original shapes and color tones. It is also possible to remove deposits and discoloring stains.

INDUSTRIAL APPLICABILITY

The present invention can be used suitably for restoration of works comprising oil paint laminated onto canvas and from which canvas is missing or in which it has been damaged; works comprising a piece of paper, Japanese "Washi" paper or silk, upon which watercolor composed of water soluble paint has been superimposed, and from which such paper, Japanese Paper or silk is missing or in which it has been damaged; works comprising a piece of paper, Japanese "Washi" paper or silk, upon which watercolor composed of water soluble paint has been superimposed, and in which the paint has faded; works comprising a piece of paper, Japanese "Washi" paper or silk, upon which watercolor composed of water soluble paint has been superimposed, and from which paint has exfoliated; works comprising a piece of paper, Japanese "Washi" paper or silk, upon which prints and/or drawings have been superimposed, and from which such paper, Japanese Paper or silk is missing or in which it has been damaged; works comprising a piece of paper, Japanese "Washi" paper or silk, upon which prints and/or drawings have been superimposed, and in which the color has faded; works comprising a piece of paper, Japanese "Washi" paper or silk, upon which prints and/or drawings have been superimposed, and from which prints and/or drawings have exfoliated.

Advantageous Effects of Invention

It is possible to shorten the time required for the restoration of paintings by use of the present invention. Moreover, by use of the present invention, it is possible to limit or eliminate variability resulting from the differing levels of skill of restorers.

The invention claimed is:

1. A method of restoring paintings comprising the steps of:

image data acquisition from a painting having at least one deteriorated part in which deterioration has occurred in forms including at least one selected from among fading of color, exfoliation of paint, and damage to or loss of the support;

generating digital restoration data in which image data of the deteriorated parts is restored by digital simulation using a computer;

printing the digital restoration data on a backing material by using ink, the backing material to be applied onto the painting; and lamination of the backing material onto the back surface of the painting after printing.

2. The method of restoring paintings according to claim 1, wherein the image data acquisition step is preceded by a step of flattening the painting.

3. The method of restoring paintings according to claim 1, wherein the image data acquisition step is preceded by a step of cleaning the image surface of the painting by removing dirt.

4. The method of restoring paintings according to claim 1, wherein the digital restoration data includes full image surface restoration data that digitally restores the entire image surface of the painting.

5. The method of restoring paintings according to claim 4, wherein the full image surface restoration data is obtained by performing contour blurring processing after the full image surface digital restoration.

6. The method of restoring paintings according to claim 4, wherein the full image surface restoration data is obtained by subjecting to a color lightening process the data in which damaged part and/or flakes of the deteriorated part have been digitally restored.

7. The method of restoring paintings according to claim 1, wherein the painting has a deteriorated part where a loss or damage has occurred, and the digital restoration data includes damaged part restoration data for supplementing the loss or damage.

8. The method of restoring paintings according to claim 7, wherein the damaged part restoration data is obtained by subjecting to a color lightening process the data in which digital restoration of the damage to or loss of the deteriorated part has been carried out.

9. The method of restoring paintings according to claim 1, wherein the lamination is carried out by means of an adhesive layer formed by applying an adhesive.

10. The method of restoring paintings according to claim 1, wherein the lamination is carried out without using an adhesive layer formed by applying an adhesive.

* * * * *